United States Patent [19]

Hull et al.

[11] Patent Number: 4,986,535

[45] Date of Patent: Jan. 22, 1991

[54] VARIABLE WEIGHT EXERCISE DEVICE

[76] Inventors: Harold L. Hull, 401 Canyon Way, Sp. 43, Sparks, Nev. 89434; Dennis J. Waite, 2245 Hedgewood Dr., Reno, Nev. 89509

[21] Appl. No.: 407,210

[22] Filed: Sep. 14, 1989

[51] Int. Cl.[5] ..... A63B 21/06

[52] U.S. Cl. ..... 272/117; 272/130

[58] Field of Search ..... 272/117, 119, 122, 123, 272/124, 130

[56] References Cited

U.S. PATENT DOCUMENTS

| | | | |
|---|---|---|---|
| 3,414,261 | 12/1968 | Hoebner | 272/117 |
| 3,427,020 | 2/1969 | Montour et al. | 272/119 |
| 4,505,474 | 3/1985 | Mattox | 272/117 X |
| 4,664,373 | 5/1987 | Hait | 272/117 |
| 4,743,016 | 5/1988 | Van Derworp et al. | 272/117 |
| 4,838,545 | 6/1989 | Wilson | 272/117 |

FOREIGN PATENT DOCUMENTS

| | | | |
|---|---|---|---|
| 452726 | 11/1927 | Fed. Rep. of Germany | 272/123 |

*Primary Examiner*—Robert Bahr

[57] ABSTRACT

A therapeutic and exercise device which is substantially a two-step hollow ladder partially filled with a viscous fluid such as water and also containing ballast such as ball bearings for adding additional weight, with the fluid and ballast shifting from one end of the ladder to the other when one end is held lower than the other, thus increasing weight slowly from one end to the other. The two-step hollow ladder also includes valves to control the rate of flow.

11 Claims, 2 Drawing Sheets

VARIABLE WEIGHT EXERCISE DEVICE

BACKGROUND OF THE INVENTION

This invention relates to an exercise device and more particularly to an exercise device which has the characteristics of being able to increase the weight of one side or the other by means of a fluid contained in the device.

Using a fluid chamber in connection with an exercise device is not new in exercise equipment as is demonstrated by patent 4,685,665 which teaches two chambers which exercises the hand when the chambers are alternately squeezed, shifting the fluid back and forth from one chamber to the other. Also U.S. Pat. No. 4,801,137 shows a variable weight hand held exercise apparatus in the form of a jumping rope, while U.S. Pat. No. 4,146,222 teaches an exercise device filled with fluid which is used to walk on.

SUMMARY OF THE INVENTION

It is a primary purpose of the present invention to provide a simple device that is simple to manufacture which can be used for therapeutic and exercise purposes and can be used while lying flat on the back, or in bed, or standing or setting and used for multiple purposes such as stretching, lifting, muscle control, upper torso exercise, wrist and arm development, etc.

It is yet another purpose to provide an apparatus that is partially filled with fluid with the fluid running to the lowest side of the device, thus slowly increasing weight on that side.

Another object is to provide an apparatus in which the motion of the fluid is controllable.

Still another object is to provide a mechanical adjustment to control the rate of flow of the fluid from one end to the other.

Yet another object is to add solid pellets such as ball bearings to the fluid to increase the weight at will.

Another object is to provide a device which is easily stored.

Another object is to provide a simple ladder which can be used to elevate the body in the manner of climbing stairs.

Other objects and advantages will become more apparent during the course of the following description when taken in connection with the accompanying drawings.

DETAILED DESCRIPTION OF THE DRAWINGS

Figure 1:
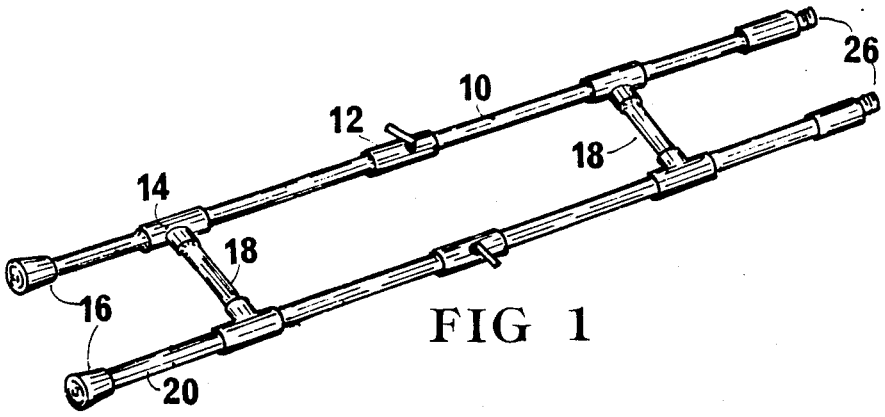
FIG. 1 is a perspective view of the device which is in the form of a hollow ladder partially filled with a fluid.
Figure 2:
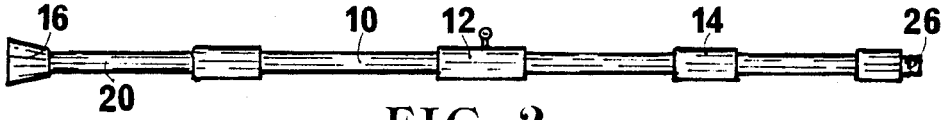
FIG. 2 is a side view.
Figure 3:
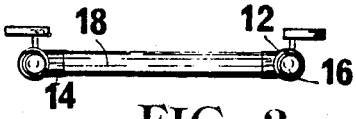
FIG. 3 is an end view.
Figure 4:
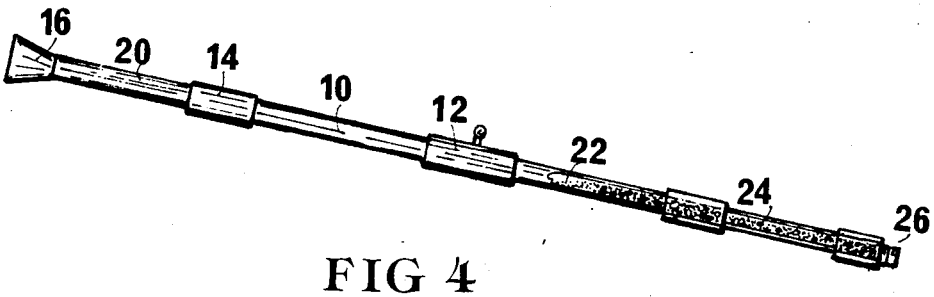
FIG. 4 is a partial cut-a-way side view showing the fluid in one end.
Figure 5:
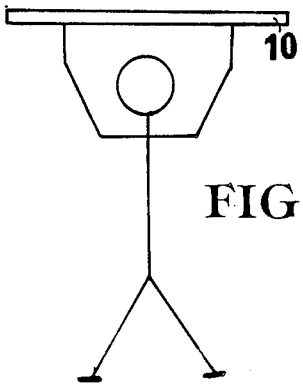
FIG. 5 is a conceptional view showing a person lifting the device over head.
Figure 6:
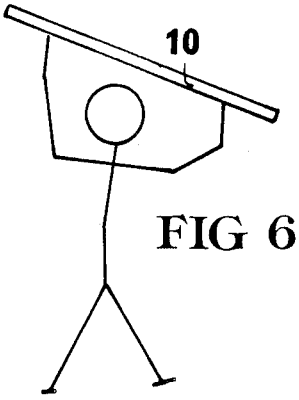
FIG. 6 is a conceptional view showing a person lowering the device lower on their right side.
Figure 7:
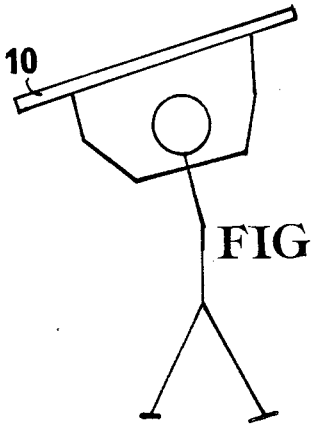
FIG. 7 is a conceptional view showing a person lowering the device on their left side.
Figure 8:
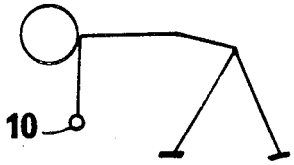
FIG. 8 is a conceptional view showing a person holding the device below the torso and stretching the arms.
Figure 9:
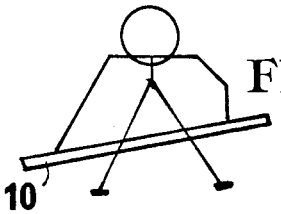
FIG. 9 is a conceptional view showing a person holding the device below the torso and lifting the device on one end.
Figure 10:
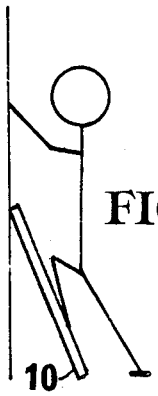
FIG. 10 is a conceptional view with the device leaning against a support such as a wall and being used as a step.
Figure 11:
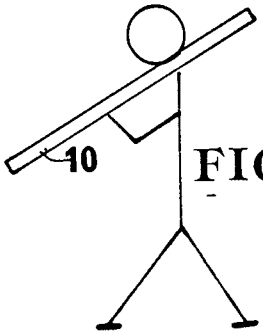
FIG. 11 is a conceptional view showing a person using the device as a neck exercise or chin lift.
Figure 12:
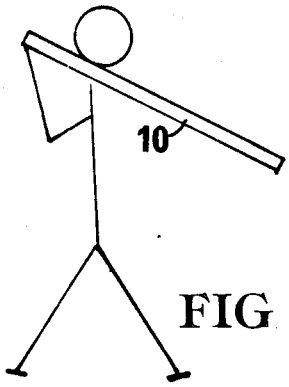
FIG. 12 is a conceptional view of the devise being used by a person as a neck exercise stretching the back of the neck.

Referring now to the drawings, wherein like reference characters designate like or corresponding parts throughout the various views, FIG. 1 shows an overview of the apparatus wherein the device in the preferred embodiment takes the form of a two-step ladder made from plastic material such as P.V.C. pipe, 10 being a section of the main frame, 12 being valves, located between two of the main frame pieces 10 which are joined to cross pieces 18 an end pieces 20 by tees 14, with the end pieces being capped by end caps 16, and at least one end cap containing a removable plug 26. The device is partially filled with a fluid 22 such as water, oil, antifreeze, or other suitable viscous fluid and if desired ball bearings 24 or other such suitable ballast may be added to increase the weight.

Now it will be seen that when the device is grasped by the two cross pieces 18 and raised over head that if one end of the device is lowered that the viscous fluid 22 will by gravity, run to the low side increasing the weight, and the ball bearings or ballast 24 will also roll or flow to the low side also increasing the weight.

FIGS. 5—12 illustrate a few examples of various exercises which may be done with the device to strengthen and exercise various parts of the body.

Now it will be seen that we have provided a simple device that is simple to manufacture from plastic, P.V.C. pipe or the like that has therapeutic and exercise value and which shifts the weight in controllable variable amounts and which may be utilized from a number of positions such as standing, sitting, lying in bed, etc., which is easily stored, and the proper use of the device can strengthen and exercise various muscles and parts of the body.

Although the invention has been herein shown and described in what is conceived to be the most practical and preferred embodiments, it is recognized that departures may be made therefrom within the scope of the invention, which is not to be limited to the details disclosed herein but it is to be accorded the full scope of the claims so as to embrace any and all equivalent devices and apparatus.

Having described our invention, what we claim as new and desire to secure by letters patent is:

1. A therapeutic and exercise device comprising: two primary hollow parallel members, said members being joined together near their extremities with two secondary hollow cross members, said primary members and said secondary members forming substantially a two step ladder, said ladder having a first end and a second end, said ladder being partially filled with a viscous fluid, said primary members having valve means located substantially near their center portions, said valve means controlling the rate of flow of said fluid from said first end of said ladder to aid second end of said ladder and said valve means controlling the rate of flow of said fluid from said second end of said ladder to said first end of said ladder, and said primary members having end caps, said caps being capable of sealing said fluid into said ladder.

2. The device of claim 1 in which said hollow ladder is constructed of poly vinyl chloride pipe.

3. The device of claim 1 in which at least one of said end caps has a removable plug.

4. The device of claim 1 in which said fluid is oil.

5. The device of claim 1 in which said fluid in water.

6. The device of claim 1 in which said fluid is anti-freeze.

7. The device of claim 1 in which said fluid contains solid granulates.

8. The device of claim 7 in which said solid granulates are ball bearings.

9. The device of claim 1 in which said ladder is made of material strong enough to support the weight of an adult person when used as a ladder.

10. The device of claim 1 in which said end caps are made of non-slip material.

11. The device of claim 10 in which said non-slip material is rubber.

* * * * *